US009677725B2

(12) United States Patent
Zheng et al.

(10) Patent No.: US 9,677,725 B2
(45) Date of Patent: Jun. 13, 2017

(54) LIGHT STRING UNIT

(71) Applicants: Dianqing Zheng, Dongguan (CN); Shaozhen Wu, Dongguan (CN)

(72) Inventors: Dianqing Zheng, Dongguan (CN); Shaozhen Wu, Dongguan (CN)

(73) Assignees: Dianqing Zheng, Dongguan (CN); Shaozhen Wu, Dongguan (CN)

( * ) Notice: Subject to any disclaimer, the term of this patent is extended or adjusted under 35 U.S.C. 154(b) by 70 days.

(21) Appl. No.: 14/724,833

(22) Filed: May 29, 2015

(65) Prior Publication Data

US 2015/0362139 A1 Dec. 17, 2015

(30) Foreign Application Priority Data

Jun. 17, 2014 (CN) ..... 2014 2 0323501 U

(51) Int. Cl.

| | |
|---|---|
| ***F21S 4/00*** | (2016.01) |
| ***F21V 23/00*** | (2015.01) |
| ***F21S 4/10*** | (2016.01) |
| *F21W 121/04* | (2006.01) |

(52) U.S. Cl.
CPC ..... *F21S 4/10* (2016.01); *F21V 23/001* (2013.01); *F21W 2121/04* (2013.01)

(58) Field of Classification Search
CPC ..... F21S 4/10; F21V 23/001; F21W 2121/04
USPC ..... 174/24, 26, 27, 28, 26 R
See application file for complete search history.

(56) References Cited

U.S. PATENT DOCUMENTS

| | | | | |
|---|---|---|---|---|
| 6,417,445 | B1 * | 7/2002 | Sato | H01B 11/1808 174/28 |
| 7,314,996 | B2 * | 1/2008 | Nakai | H01B 11/1808 174/102 R |
| 9,140,438 | B2 * | 9/2015 | Chen | F21V 23/001 |

* cited by examiner

*Primary Examiner* — Alan Cariaso
(74) *Attorney, Agent, or Firm* — Gokalp Bayramoglu

(57) ABSTRACT

The present application provides a light string unit, including: a plurality of light-emitting bodies; and a conducting wire, configured to electrically connect the light-emitting bodies in series, opposite ends of the conducting wire being connected to positive polarity and negative polarity of an external power supply circuit or an external power source, respectively. Wherein, the conducting wire is a high-tensile conducting wire which includes: a conductive core wire; an insulated coating, configured to encapsulate the conductive core wire; and a tensile resistant cord, set inside the insulated coating and set parallelly or twisted with the conductive core wire to enhance the tensile strength of the conducting wire. In the present application, the tensile resistant cord enhances the tensile strength of the conducting wire, and completely reaches or even exceeds the requirement on tensile strength of a conducting wire in the UL 588 criterion and has a simplified structure.

6 Claims, 2 Drawing Sheets

LIGHT STRING UNIT

TECHNICAL FIELD

The present application relates to a light string unit for illumination and decoration.

BACKGROUND ART

A traditional conducting wire of a light string unit for illumination and decoration composes of a conductor and a PVC shell. For this reason, the traditional conducting wire of the light string unit can not reaches a requirement on tensile strength of a conducting wire in the UL 588 criterion. Therefore, in one of existing improvements, one half length of the conducting wire of the light string unit comes into series connection with a lamp body, and the other half length of the conducting wire is folded back to twist the half conducting wire of the light string unit (which is so called as twisted wire). This kind of improvement has following disadvantages: materials are wasted since only half length of the conducting wire comes into series connection with the lamp body; conducting wires between each two lamp bodies are necessarily manually twisted after the light string is processed, which consumes a great of working hours and can not guarantee the quality of twisted wires; in addition, since the conducting wires are electrically connected in whole length, if the PVC shell is cracked in the twisting process, two conductors of twisted wires may easily come into contact to further cause a short circuit to damage the light string unit when the light string unit is energized.

In order to eliminate the disadvantages of the above improvement, in another one of improvements, a non-conducting wire (which is so called as fake wire) is additionally provided between each two lamp bodies of the light string unit, wherein a connection part for the non-conducting wire is provided on a bottom of the lamp body, both ends of the non-conducting wire are fixedly connected to the connection part on the bottom of the lamp body respectively, or are folded to be embedded in the connection part on the bottom of the lamp body, and finally the conducting wire and the non-conducting wire are twisted together. In this kind of improvement, however, materials of the non-conducting wire are also consumed, and the connection part for the non-conducting wire is necessarily provided on the bottom of the lamp body so as to make the lamp body or the structure of the light string become relatively complex; working hours are necessarily increased to install the non-conducting wires; especially, if the non-conducting wire and the connection part on the bottom of the lamp body are unreliably connected such that they could be released in a pulling process, the light string unit would have only the traditional conducting wire connection, the tensile strength of which can not reach the requirement of the UL 588.

SUMMARY OF THE INVENTION

Aim at the disadvantages in prior art, the present application provides a light string unit which may have a simplified structure, completely reach or even exceed the requirement on tensile strength of a conducting wire in the UL 588 criterion, and have reduced working hours and the consumption of materials.

To address above technical problems, a solution employed by the present application is: a light string unit, including:

a plurality of light-emitting bodies; and a conducting wire, configured to electrically connect the light-emitting bodies in series, opposite ends of the conducting wire being connected to positive polarity and negative polarity of an external power supply circuit or an external power source, respectively, wherein, the conducting wire is a high-tensile conducting wire which includes:

a conductive core wire;

an insulated coating, configured to encapsulate the conductive core wire; and a tensile resistant cord, set inside the insulated coating and set parallelly or twisted with the conductive core wire to enhance the tensile strength of the conducting wire.

Particularly, the tensile resistant cord is one of non-metallic cotton thread, non-metallic yarn or non-metallic plastic thread, or one of insulating layer coated aluminum wire, insulating layer coated iron wire or insulating layer coated copper wire.

Further, the tensile resistant cord is a combination of two of non-metallic cotton thread, non-metallic yarn or non-metallic plastic thread, or a combination of two of insulating layer coated aluminum wire, insulating layer coated iron wire or insulating layer coated copper wire, or a combination of one of non-metallic cotton thread, non-metallic yarn or non-metallic plastic thread and one of insulating layer coated aluminum wire, insulating layer coated iron wire or insulating layer coated copper wire.

In comparison with the prior art, the present application may have the following advantageous effects: the tensile resistant cord is set inside the insulated coating of the conducting wire to enhance the tensile strength of the conducting wire, and the high-tensile conducting wire integrally formed in the conducting wire forming process may greatly enhance the tensile strength of the conducting wire to completely reach or even exceed the requirement on tensile strength of a conducting wire in the UL 588 criterion, and have a simplified structure of the light string unit. Further, since it is integrally formed in the conducting wire forming process, the twisting process may be omitted, in such a manner that the assembling process may be simplified and working hours may be reduced while the consumption of materials is cut down, which means manufacturing cost may be decreased while the quality is guaranteed. Moreover, the disadvantages in which two conductors of twisted wires may easily come into contact to further cause a short circuit to damage the light string when the light string unit is energized due to the cracked PVC shell in the twisting process in prior art may be solved; and the risk in which the non-conducting wire and the connection part on the bottom of the lamp body are unreliably connected such that they could be released in a pulling process so as to the non-conducting wire fails to enhance the tensile strength of the conducting wire may be eliminated.

Figure 1:
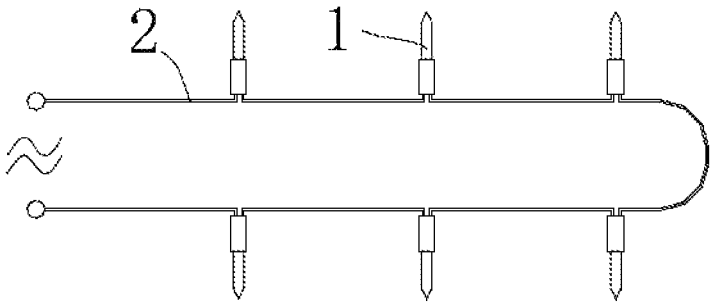
FIG. 1 is a schematic structural diagram of a light string unit according to an embodiment of the present application.

In reference numerals, 1 is a light-emitting body; 2 is a high-tensile conducting wire; 21 is a conductive core wire; 22 is an insulated coating; and 23 is a tensile resistant cord.

DETAILED DESCRIPTION OF THE EMBODIMENTS

Hereinafter, preferred embodiments of the present application will be described in connection with the accompanying drawings.

Figure 2:
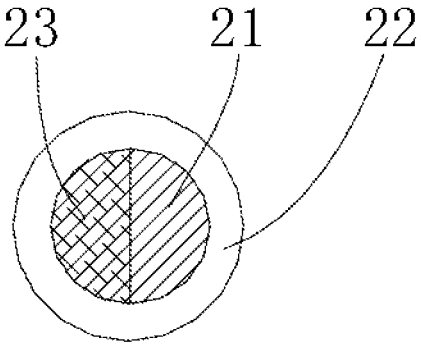
FIG. 2 is an enlarged diagram of a conducting wire of a light string unit according to a first embodiment of the present application.
Figure 3:
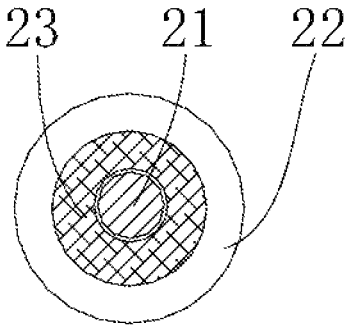
FIG. 3 is an enlarged diagram of a conducting wire of a light string unit according to a second embodiment of the present application.

With reference to FIG. 1, a light string unit according to the present application may includes a plurality of light-emitting bodies 1, and a high-tensile conducting wire 2 configured to electrically connect the light-emitting bodies 1 in series. Opposite ends of the high-tensile conducting wire 2 are connected to positive polarity and negative polarity of an external power supply circuit or an external power source, respectively. The high-tensile conducting wire 2 (as shown in FIG. 2 or FIG. 3) may include a conductive core wire 21, an insulated coating 22 configured to encapsulate the conductive core wire and a tensile resistant cord 23 set inside the insulated coating 22 to enhance the tensile strength of the conducting wire. The tensile resistant cord 23 may be set parallelly with the conductive core wire 21 (as shown in FIG. 2), or the tensile resistant cord 23 may be set around an outer wall of the conductive core wire 21 (as shown in FIG. 3), or the tensile resistant cord 23 may be twisted with the conductive core wire 21.

The high-tensile conducting wire 2 may be made by parallelly conveying the conductive core wire 21 and the tensile resistant cord 23 to a conducting wire forming machine to integrally form in the insulated coating 22, or by wrapping the outer wall of the conductive core wire 21 by the tensile resistant cord 23 and conveying them together to a conducting wire forming machine to integrally form in the insulated coating 22, or by twisting the conductive core wire 21 and the tensile resistant cord 23 and conveying them together to a conducting wire forming machine to integrally form in the insulated coating 22.

Herein, the tensile resistant cord is formed by weaving at least a strand of thread or several strands of threads. In particular, the tensile resistant cord may be one of non-metallic cotton thread, non-metallic yarn or non-metallic plastic thread, or may be one of insulating layer coated aluminum wire, insulating layer coated iron wire or insulating layer coated copper wire.

The assembling process of the light string unit according to the present application is as the same as that of traditional light string unit.

In the light string unit according to the present application, the tensile resistant cord is set inside the insulated coating of the conducting wire to enhance the tensile strength of the conducting wire, and the high-tensile conducting wire integrally formed in the conducting wire forming process may greatly enhance the tensile strength of the conducting wire to completely reach or even exceed the requirement on tensile strength of a conducting wire in the UL 588 criterion, and have a simplified structure of the light string unit. Further, since it is integrally formed in the conducting wire forming process, the twisting process may be omitted, in such a manner that the assembling process may be simplified and working hours may be reduced while the consumption of materials is cut down, which means manufacturing cost may be decreased while the quality is guaranteed. Moreover, the disadvantages in which two conductors of twisted wires may easily come into contact to further cause a short circuit to damage the light string when the light string unit is energized due to the cracked PVC shell in the twisting process in prior art may be solved; and the risk in which the non-conducting wire and the connection part on the bottom of the lamp body are unreliably connected such that they could be released in a pulling process so as to the non-conducting wire fails to enhance the tensile strength of the conducting wire may be eliminated.

Preferably, in order to improve the tensile strength of the high-tensile conducting wire, the tensile resistant cord may be a combination of two of non-metallic cotton thread, non-metallic yarn or non-metallic plastic thread, or may be a combination of two of insulating layer coated aluminum wire, insulating layer coated iron wire or insulating layer coated copper wire, or may be a combination of one of non-metallic cotton thread, non-metallic yarn or non-metallic plastic thread and one of insulating layer coated aluminum wire, insulating layer coated iron wire or insulating layer coated copper wire.

Above disclosed are only preferred embodiments of the present application. Of course, the scope of the present application should not be limited thereby, but any equivalent modifications made in accordance with the scope of the present application will fall within the scope enclosed by the present application.

What is claimed:

1. A light string unit, comprising:

a plurality of light-emitting bodies; and a conducting wire, configured to electrically connect the light-emitting bodies in series, opposite ends of the conducting wire being connected to positive polarity and negative polarity of an external power supply circuit or an external power source, respectively, wherein, the conducting wire being a high-tensile conducting wire which includes:

a conductive core wire;

an insulated coating, configured to encapsulate the conductive core wire; and a tensile resistant cord, set inside the insulated coating to enhance the tensile strength of the conducting wire;

wherein the tensile resistant cord and the conductive core wire are integrally formed in the insulated coating, and the tensile resistant cord is around an outer wall of the conductive core wire.

2. The light string unit according to claim 1, wherein the tensile resistant cord is one of non-metallic cotton thread, non-metallic yarn or non-metallic plastic thread.

3. The light string unit according to claim 1, wherein the tensile resistant cord is one of insulating layer coated aluminum wire, insulating layer coated iron wire or insulating layer coated copper wire.

4. The light string unit according to claim 1, wherein the tensile resistant cord is a combination of two of non-metallic cotton thread, non-metallic yarn or non-metallic plastic thread, or a combination of two of insulating layer coated aluminum wire, insulating layer coated iron wire or insulating layer coated copper wire, or a combination of one of non-metallic cotton thread, non-metallic yarn or non-metallic plastic thread and one of insulating layer coated aluminum wire, insulating layer coated iron wire or insulating layer coated copper wire.

5. A light string unit, comprising:

a plurality of light-emitting bodies; and a conducting wire, configured to electrically connect the light-emitting bodies in series, opposite ends of the conducting wire being connected to positive polarity and negative polarity of an external power supply circuit or an external power source, respectively, wherein, the conducting wire being a high-tensile conducting wire which includes:

a conductive core wire;

an insulated coating, configured to encapsulate the conductive core wire; and a tensile resistant cord, set inside the insulated to enhance the tensile strength of the conducting wire;

wherein the tensile resistant cord and the conductive core wire are integrally formed in the insulated coating, and the tensile resistant cord is around an outer wall of the conductive core wire;

wherein the tensile resistant cord is an insulating layer coated aluminum wire.

6. A light string unit, comprising:

a plurality of light-emitting bodies; and a conducting wire, configured to electrically connect the light-emitting bodies in series, opposite ends of the conducting wire being connected to positive polarity and negative polarity of an external power supply circuit or an external power source, respectively, wherein, the conducting wire being a high-tensile conducting wire which includes:

a conductive core wire;

an insulated coating, configured to encapsulate the conductive core wire; and a tensile resistant cord, set inside the insulated to enhance the tensile strength of the conducting wire;

wherein the tensile resistant cord and the conductive core wire are integrally formed in the insulated coating, and the tensile resistant cord is around an outer wall of the conductive core wire;

wherein the tensile resistant cord is a combination of two insulating layer coated aluminum wires.

* * * * *